US005544470A

United States Patent [19]

Yarbrough

[11] Patent Number: 5,544,470

[45] Date of Patent: Aug. 13, 1996

[54] MACHINE AND PROCESS FOR SEALING WRAPPED EPOXY STICKS

[75] Inventor: Harvey M. Yarbrough, Ringgold, Ga.

[73] Assignee: Illinois Tool Works Inc., Glenview, Ill.

[21] Appl. No.: 418,020

[22] Filed: Apr. 6, 1995

[51] Int. Cl.[6] ..... B65B 53/02

[52] U.S. Cl. ..... 53/442; 53/557; 53/213; 53/461

[58] Field of Search ..... 53/442, 461, 557, 53/210, 213, 373.8, 373.9, 376.2, 463, 375.9; 34/218, 219; 156/212, 215

[56] References Cited

U.S. PATENT DOCUMENTS

| | | | |
|---|---|---|---|
| 1,887,844 | 11/1932 | Malocsay . | |
| 2,581,309 | 1/1952 | Stephano . | |
| 3,432,982 | 3/1969 | Brinkmeier et al. . | |
| 3,629,993 | 12/1971 | Chant, Jr. . | |
| 3,881,296 | 5/1975 | Bate | 53/442 |
| 4,225,318 | 9/1980 | Wrigley, Jr. . | |
| 4,546,875 | 10/1985 | Zweber | 53/465 |
| 4,642,239 | 2/1987 | Ferrar et al. | 53/442 |
| 4,958,480 | 9/1990 | Warner | 53/442 |
| 5,299,406 | 4/1994 | Laury | 53/442 |
| 5,313,766 | 5/1994 | Rimondi et al. | 53/451 |
| 5,400,570 | 3/1995 | Bennett | 53/442 |

FOREIGN PATENT DOCUMENTS

| | | |
|---|---|---|
| 2203976 | 8/1973 | Germany . |
| 4-367422 | 12/1992 | Japan . |
| 469696 | 7/1937 | United Kingdom . |

*Primary Examiner*—John Sipos
*Assistant Examiner*—Gene L. Kim
*Attorney, Agent, or Firm*—Richard C. Litman

[57] ABSTRACT

A machine for sealing epoxy sticks has a conveyor belt system and a heating chamber. The speed of the conveyor belt is adjustable. The heating chamber has heating elements which can be spatially adjusted to be nearer to or farther from the sticks to be sealed. The temperature of the heating elements can also be adjusted. A method of using the machine includes a step of the orienting the grain of plastic wrapping used to wrap the epoxy sticks.

7 Claims, 2 Drawing Sheets

44
20
14
22
22
21
18
14
10
12
12
16

MACHINE AND PROCESS FOR SEALING WRAPPED EPOXY STICKS

BACKGROUND OF THE INVENTION

1. Field of the Invention

The present invention relates to generally to sealing machines and processes, and more particularly to machines and processes for sealing epoxy sticks in plastic.

2. Description of the Prior Art

Wrapping epoxy sticks is an important aspect of delivering epoxy stick products to an end user. Without proper wrapping, epoxy sticks can dry out and become useless. Yet, prior to the present invention, wrapping an epoxy stick was a time-consuming and expensive process. Formerly, conventional practice was to place foil disks on ends of an epoxy stick, and then wrap the stick in plastic wrapping material. Because this conventional process is both expensive and time-consuming, a new method is needed that does not require use of foil disks and that can use inexpensive polyethylene wrapping. Other sealing processes have been developed, but none provides the desirable epoxy-stick wrapping characteristics of the present invention.

U.S. Pat. No. 1,887,844, issued on Nov. 15, 1932, to Francis X. Malocsay, describes a sealing device for cigar-wrapping machines. The device heat-seals twisted ends of cigar wrappers. This patent does not show spatially adjustable heating elements, adjustable-speed conveyor belts, or the technique of orienting polyethylene wrappers with a grain parallel to a long axis of a wrapped cylindrical object.

U.S. Pat. No. 2,581,309, issued on Jan. 1, 1952, to Constantine S. Stephano, describes a relatively complicated mechanism for first folding and then heat-sealing ends of cigarette wrappers. This patent does not show spatially adjustable heating elements, adjustable-speed conveyor belts, or the technique of orienting polyethylene wrappers with a grain parallel to a long axis of a wrapped cylindrical object.

U.S. Pat. No. 3,432,982, issued on Mar. 18, 1969, to Friedheim Brinkmeier et al., describes a bag-sealing device which requires cleaning of bag-portions to be sealed, prior to sealing. This patent does not show spatially adjustable heating elements, adjustable-speed conveyor belts, or the technique of orienting polyethylene wrappers with a grain parallel to a long axis of a wrapped cylindrical object.

U.S. Pat. No. 3,629,993, issued on Dec. 28, 1971, to Albert H. Chant, Jr., describes a wrapping devices which requires gripper chains to stretch film to be heat sealed. This patent does not show spatially adjustable heating elements, adjustable-speed conveyor belts, or the technique of orienting polyethylene wrappers with a grain parallel to a long axis of a wrapped cylindrical object.

U.S. Pat. No. 4,225,318, issued on Sept. 30, 1980, to Hank J. Wrigley, Jr., shows a sealed package but does not describe sealing methods or apparatus. There is a wick hermetically sealed between two layers of plastic, with no indication of the manner of sealing or the grain orientation of the sealed wrapping.

Great Britain Patent 469,696, issued on Jul. 30, 1937, to American Marine & Foundry Company, describes a device for heat sealing folded bread wrappers. This patent does not show spatially adjustable heating elements, adjustable-speed conveyor belts, or the techinque of orienting polyethylene wrappers with a grain parallel to a long axis of a wrapped cylindrical object.

German Patent 2 203 976, issued on Aug. 2, 1973, to Werner Hoschele et al., describes a machine that forms open bags via heat sealing and closes the bags with metal clips. This patent does not show spatially adjustable heat-sealing elements, adjustable-speed conveyor belts, or the technique of orienting polyethylene wrappers with a grain parallel to a long axis of a wrapped cylindrical object.

None of the above inventions and patents, taken either singly or in combination, is seen to describe the instant invention as claimed.

SUMMARY OF THE INVENTION

According to the present invention, a machine for sealing epoxy sticks comprises a conveyor belt system and a heating chamber. The speed of the conveyor belt is adjustable. The heating chamber has heating elements which can be adjusted to be nearer to or farther from the sticks to be sealed. The temperature of the heating elements can also be adjusted. A method of using the machine is also provided.

Accordingly, it is a principal object of the invention to provide a machine for sealing epoxy sticks in a wrapping.

It is another object of the invention to provide adjustable heating elements for sealing wrapped epoxy sticks.

It is a further object of the invention to provide adjustable speed through a sealing machine for epoxy sticks.

Still another object of the invention is to effectively seal entire epoxy sticks merely by applying heat to ends of wrapped epoxy sticks.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
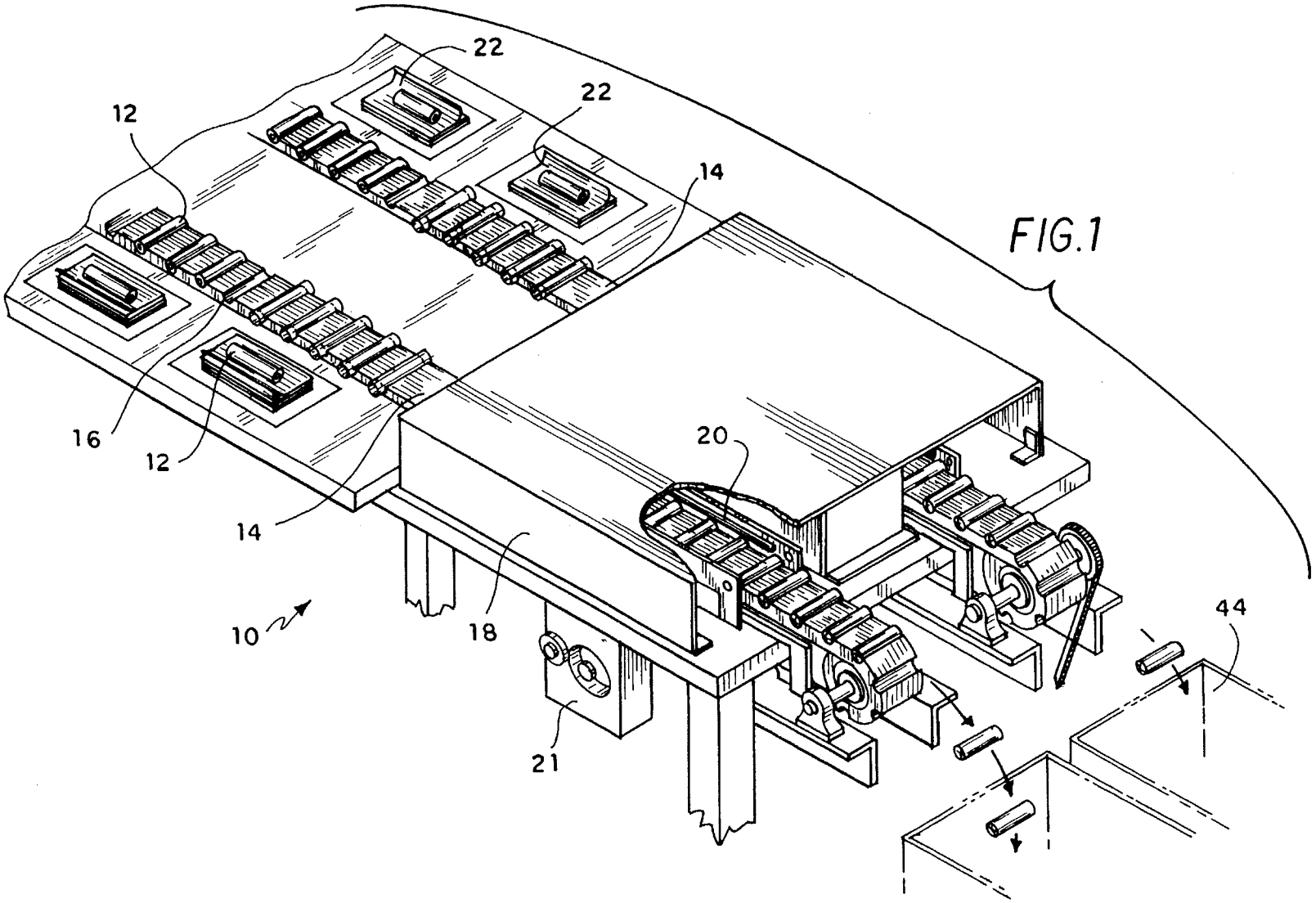
FIG. 1 is an environmental, perspective view of the present invention showing the grain-oriented epoxy-stick wrappings and the sealing machine.
Figure 2:
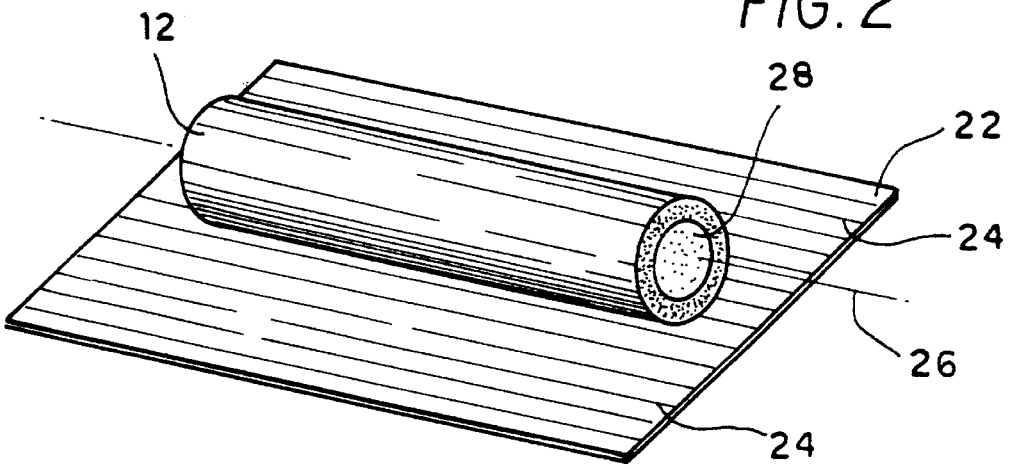
FIG. 2 is a detail view showing the grain of the epoxy-stick wrapping relative to a longitudinal axis of an epoxy stick.
Figure 3:
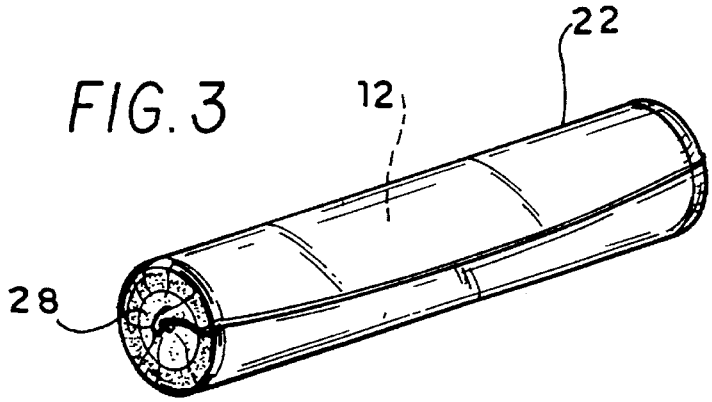
FIG. 3 is a perspective view of a wrapped epoxy stick subsequent to sealing.

Epoxy is a glue material that can be distributed to end users in the form of "sticks," i.e. truncated cylinders. The volatile nature of certain ingredients of typical epoxy sticks necessitates adequate wrapping of such epoxy sticks, in order to ensure lasting efficacy. However, wrapping epoxy sticks has conventionally been an expensive and time-consuming process. In recognition of the importance of wrapping epoxy sticks and the problems conventionally the foil disks used in prior wrapping procedures, and substantially reduces the time and effort inherent in wrapping epoxy sticks.

Referring to the drawings, the present invention comprises a machine 10 for sealing epoxy sticks 12. There are preferably two conveyor belts 14, although more or fewer could be used, each having indentations 16 of a shape and size appropriate for receiving and conveying epoxy sticks 12. Disposed adjacent to the conveyor belts 14 are stacks of cut wrapping material 22 dimensioned to wrap around epoxy sticks 12 such that a grain 24 of the wrapping material 22 is oriented in parallel with a longitudinal axis 26 of the epoxy stick 12. The conveyor belts 14 are connected to known means for providing independently adjustable conveying speeds 38 and pass through a heating chamber 18. In the heating chamber 18, there is a plurality of heating elements 20 that direct heat towards the conveyor belts 14. The heating elements 20 have known means for spatial adjustment 40 so that the heating elements 20 can be adjusted spatially. Additionally, the heating elements 20 are connected to known means for adjusting temperature 42 so that the heating elements 20 have adjustable temperatures. The heating chamber 18 has an externally disposed control panel 21 of known type for controlling, and connected by known means to, the means for providing independently adjustable conveying speeds 38 of the conveyor belts 14, the spatial heater adjustment means 40, and the temperature adjustment means 42.

In use of the machine 10, the plastic wrapping material 22, preferably polyethylene, disposed adjacent to the conveyor belts 14 is hand-wrapped on the epoxy sticks 12. The wrapping is accomplished such that wrapping material 22, when wrapped around an epoxy stick 12, overlaps laps itself along a longitudinal axis 26 sticks 12. Preferably, the difference in lengths is about five-eighths of an inch. Thus, when an epoxy stick 12 is centered on the wrapping material 22, the wrapping material 22 extends, preferably about five-sixteenths of an inch beyond ends of the epoxy sticks 12. The wrapping material 22 has a definite grain 24, which is oriented in parallel with the longitudinal axis 26 of the epoxy sticks 12. The wrapping material 22 tends to melt under said heat, whereupon the wrapping material 22 heat-seals closed ends 28 of the epoxy sticks 12. The overlapping region 30 remains unsealed, yet nearly air-tight, owing to tension that develops as sealing of the wrapping material occurs. If the grain 24 of the wrapping material 22 were oriented perpendicular to a long axis 26 of the epoxy sticks 12, this result would be a problem; instead, the wrapping material 22 would shrink inward and leave ends 28 of the epoxy sticks 12 uncovered. In other words, the orientation of the grain 24 of the wrapping material 22 is critical, and incorrect orientation results in failure of the sealing machine 10 to seal the epoxy sticks 12.

A method of sealing epoxy sticks 12 includes the steps of receiving the epoxy sticks 12 on two conveyor belts 14 having indentations 16 that are dimensioned and configured to receive epoxy sticks 14. The conveyor belts 12 have independently adjustable conveying speeds. As the epoxy sticks 12 are conveyed by the conveyor belts 14, the epoxy sticks 12 are wrapped, such as by hand-wrapping, in plastic wrapping material 22, preferably polyethylene, having a definite grain 24 and being about an inch longer than the epoxy stick 12. Importantly, the grain 24 is oriented in parallel with a long axis of an epoxy stick 12, and about half an inch of said wrapping material 22, extends beyond the conveyor belts 14. Because the speeds of the conveyor belts 14 are independently adjustable, the duration for which the epoxy sticks 12 remain in the heating chamber 18 can be controlled. The heating elements 20 are spatially adjustable and have adjustable temperatures. These adjustable aspects of the heating elements 20 allow control over the amount of heat which the wrapping material 22 on the epoxy sticks 12 receives. By use of the control panel 21 for adjusting the conveying speed, the spatially adjustable heating elements 20 and the adjustable temperatures of the heating elements 20, a worker can fully adjust the sealing of the wrapping material 22 on the epoxy sticks 12. Upon passing through the chamber 18, the epoxy sticks 12 are completely sealed and are then released from the conveyor belts 14 into bins 44.

It is to be understood that the present invention is not limited to the sole embodiment described above, but encompasses any and all embodiments within the scope of the following claims.

I claim:

1. A heat-sealing machine comprising:

means for conveying, comprising at least one conveyor belt dimensioned and configured to convey hand-wrapped epoxy sticks having a plastic wrapping material having a grain oriented in parallel with a long axis of each epoxy stick;

means for adjusting a conveying speed of said conveyor belt;

a heating chamber through which said at least one conveyor belt passes;

a plurality of heating elements in said heating chamber, said heating elements directing heat towards said at least one conveyor belt;

means for spatially adjusting said heating elements;

means for adjusting temperatures of said heating elements; and a control panel for controlling said means for adjusting a conveying speed of said conveyor belt, said means for spatially adjusting said heating elements, and said means for adjusting temperatures of said heating elements for heat sealing the wrapper around said hand-wrapped epoxy sticks with minimal shrinking of the wrapper in the axial direction.

2. The machine according to claim 1, wherein:

there are two of said conveyor belts; and means for adjusting the conveying speed of said conveyor belt independently adjusts the conveying speeds of said conveyor belts.

3. The machine according to claim 1, wherein said plastic wrapping material is polyethylene.

4. A process for sealing hand-wrapped epoxy sticks comprising the steps of:

receiving two-ended epoxy sticks on at least one conveyor belt dimensioned and configured to convey epoxy sticks, said at least one conveyor belt having an adjustable conveying speed;

wrapping by hand said received epoxy sticks in plastic wrapping material having a grain, said grain being oriented in parallel with a long axis of an epoxy stick and overlapping said wrapping material along said long axis of said epoxy stick at least one-quarter of an inch;

ensuring that a predetermined length of said wrapping material extends beyond ends of the epoxy sticks having an overlap before sealing of at least five-sixteenths of an inch; and further conveying the hand-wrapped epoxy sticks on said at least one conveyor belt through a heating chamber having a plurality of heating elements that direct heat toward said at least one conveyor belt and heat-seal said wrapping material around the hand-wrapped epoxy sticks for heat sealing the wrapper around said hand-wrapped epoxy sticks with minimal shrinking of the wrapper in the axial direction.

5. The process according to claim 4, further including the step of adjusting speeds of said at least one conveyor belt to more completely heat-seal said wrapping material.

6. The process according to claim 4, further including the step of spatially adjusting said heating elements to more completely heat-seal said wrapping material.

7. The process according to claim 4, further including the step of adjusting temperatures of said heating elements to more completely heat-seal said wrapping material.

* * * * *